US005266998A

United States Patent [19]

Lee

[11] Patent Number: 5,266,998

[45] Date of Patent: Nov. 30, 1993

[54] ELECTROPHOTOGRAPHY PROCESSOR HAVING DETACHABLE ELECTROPHOTOGRAPHIC COMPONENTS

[75] Inventor: Dong-Ho Lee, Sungnam, Rep. of Korea

[73] Assignee: SamSung Electronics Co., Ltd., Suwon, Rep. of Korea

[21] Appl. No.: 770,237

[22] Filed: Oct. 3, 1991

[30] Foreign Application Priority Data

Apr. 17, 1991 [KR] Rep. of Korea ..... 1991-6145

[51] Int. Cl.[5] ..... G03G 15/00

[52] U.S. Cl. ..... 355/210; 355/200; 355/245; 355/260

[58] Field of Search ..... 355/260, 210, 211, 200, 355/245; 222/DIG. 1

[56] References Cited

U.S. PATENT DOCUMENTS

| | | | |
|---|---|---|---|
| 3,985,436 | 10/1976 | Tanaka et al. | 355/200 |
| 4,206,682 | 4/1993 | Yamada et al. | 355/200 |
| 4,435,065 | 3/1984 | Wada | 355/260 |
| 4,625,895 | 12/1986 | Tsukano | 355/260 X |
| 4,740,808 | 4/1988 | Kasamura et al. | 355/260 |
| 4,937,628 | 6/1990 | Cipolla et al. | 355/260 |
| 5,051,778 | 9/1991 | Watanabe et al. | 355/200 |
| 5,078,303 | 1/1992 | Kikuchi et al. | 355/260 X |
| 5,105,221 | 4/1992 | Takahashi et al. | 355/210 |
| 5,204,713 | 4/1993 | Yamamura | 355/210 |

FOREIGN PATENT DOCUMENTS

| | | | |
|---|---|---|---|
| 63-220285 | 9/1988 | Japan | 355/260 |
| 63-220286 | 9/1988 | Japan | 355/260 |

*Primary Examiner*—A. T. Grimley
*Assistant Examiner*—Shuk Y. Lee
*Attorney, Agent, or Firm*—Robert E. Bushnell

[57] ABSTRACT

An electrophotography processor has detachable electrophotographic component parts representing by main body frame, a developing device, a toner box, and a light-sensitive drum unit including a light-sensitive drum, cleaning device and charging device integrated in a unit, wherein the developing device and light-sensitive drum unit is detachably mounted in the main body frame, and the toner box is detachably mounted on the developing device.

7 Claims, 4 Drawing Sheets

ELECTROPHOTOGRAPHY PROCESSOR HAVING DETACHABLE ELECTROPHOTOGRAPHIC COMPONENTS

FIELD OF THE INVENTION

This invention relates to a toner box and the related components of electrophotography processors such as laser printers, facsimile machines, etc.

TECHNICAL BACKGROUND OF THE INVENTION

Generally the electrophotography processor comprises a charging device 5, developing device 20, transfer and separating unit 3, and cleaning unit 16 installed about a light-sensitive drum as shown in FIG. 1. In such a conventional electrophotography, the corona discharge generated from a corona wire 5' of the charging device being charged with high voltage current of about 6 KV makes the surface of the light-sensitive drum 4 charged with a given voltage. When the charged surface of the light-sensitive drum being exposed to the light emitted from a light-emitting device selectively, the portions of the surface exposed and not exposed have different voltages respectively, and accordingly the electrically latent image is formed on the surface. The light emitting device comprises a laser diode and an LED head array or a lamp. For example, in a copy machine, the light generated from the lamp is flashed on the manuscript and the surface of the light-sensitive drum is exposed to the light reflected from the manuscript. The electrostatic latent image of the light-sensitive drum is developed by the toner of a developing device 20. This developed image is transferred to the paper 2' transmitted from a paper cassette by a register roller 2. The residual toner on the light sensitive drum is eliminated by the cleaning device 16 and the transferred image on the paper is fixed by a fixing device 8. The numbers 9 and 10 are a discharging roller and a trays, respectively.

Generally in the prior art, the electrophotography processor incorporates a monolithic body comprising a light-sensitive drum, a charging device, a cleaning device and a developing device 20 constructed undetachable as shown in FIG. 2A. The life of the light-sensitive drum is to print about 15,000 sheets of paper and the life of the developing device is to process more than 50,000 sheets of paper. The toner box is designed to treat only 3,000 to 4,000 sheets of paper because the toner box becomes bigger to treat greater quantity and the bigger toner box creates inconveniences for users to handle. Accordingly, replacing the used toner box results in an uneconomical problem to scrap the usable light-sensitive drum and developing device all at once. To solve this problem, it is suggested to incorporate one unit comprising the light-sensitive drum, the cleaning device, and the charging device and the other one comprising the developing device 20 and the toner box 21 as shown in FIG. **2-*b*. However this solution also has an uneconomical problem to scrap the developing device when replacing the toner box 21**.

On the other hand, another improvement is introduced to solve the above mentioned problems as shown in FIG. 2C. In this case, a light-sensitive drum 4, a cleaning device, and a charging device 5 are integrated in a unit. Further, a developing device and a toner box are detachably mounted. Accordingly, each unit can be replaced independently according to their respective life. But even if it is economical to use each device according to its life, it is difficult to perform maintenance and to repair work on this system.

SUMMARY OF THE INVENTION

The object of this invention is to provide an electrophotography processor of which maintenance and repair work can be done easily.

According to the present invention, there is provided an electrophotography processor comprising a main body frame, a developing device, a toner box, and a light-sensitive drum unit including a light-sensitive drum, cleaning device and charging device integrated in a unit, wherein the developing device and light-sensitive drum unit is detachably mounted in the main body frame, and the toner box is detachably mounted on the developing device.

The present invention will now be described more specifically with reference to the drawings attached only by way of example.

BRIEF DESCRIPTION OF THE ATTACHED DRAWING

DETAILED DESCRIPTION OF CERTAIN PREFERRED EMBODIMENTS

Figure 1:
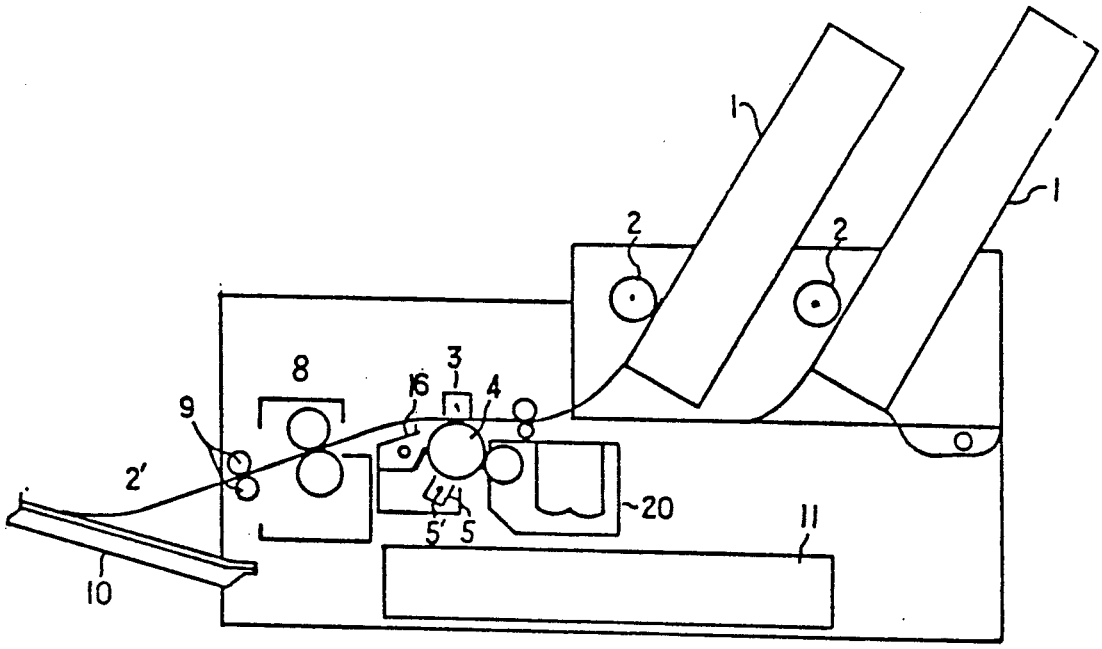
FIG. 1 is an schematic diagram of a electrophotography processor.
Figure 2A:
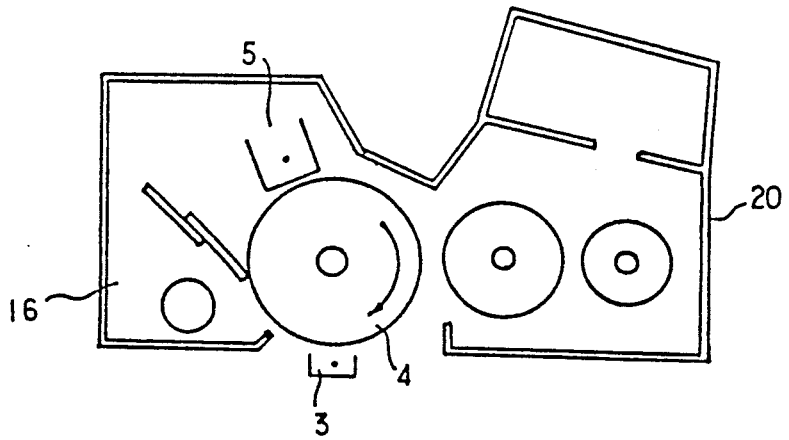
FIGS. 2A, 2B and 2C are a schematic diagram of a conventional electrophotography processor.
Figure 2B:
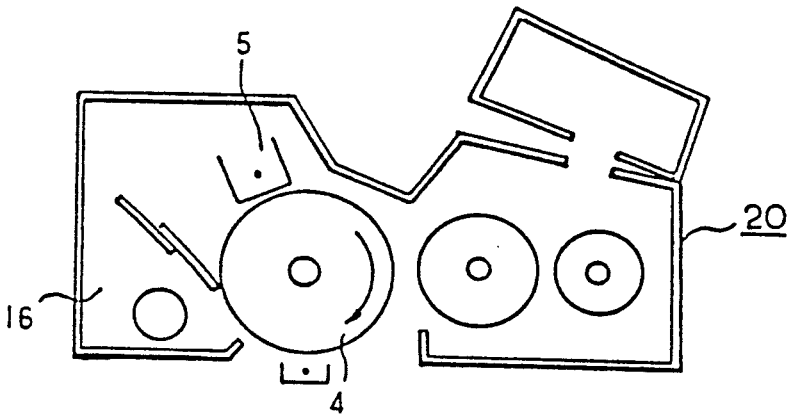
Figure 2C:
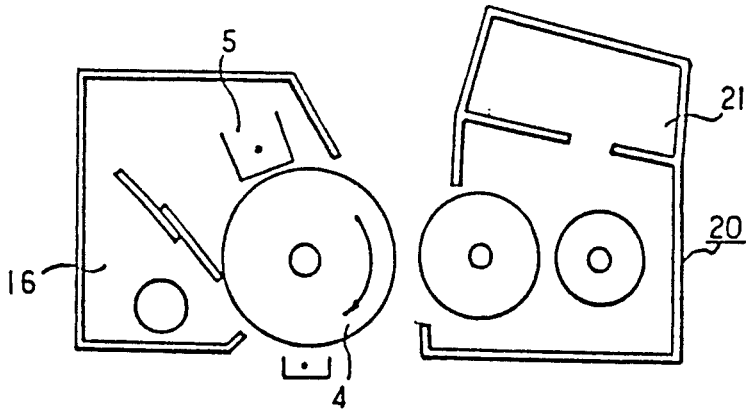
Figure 3:
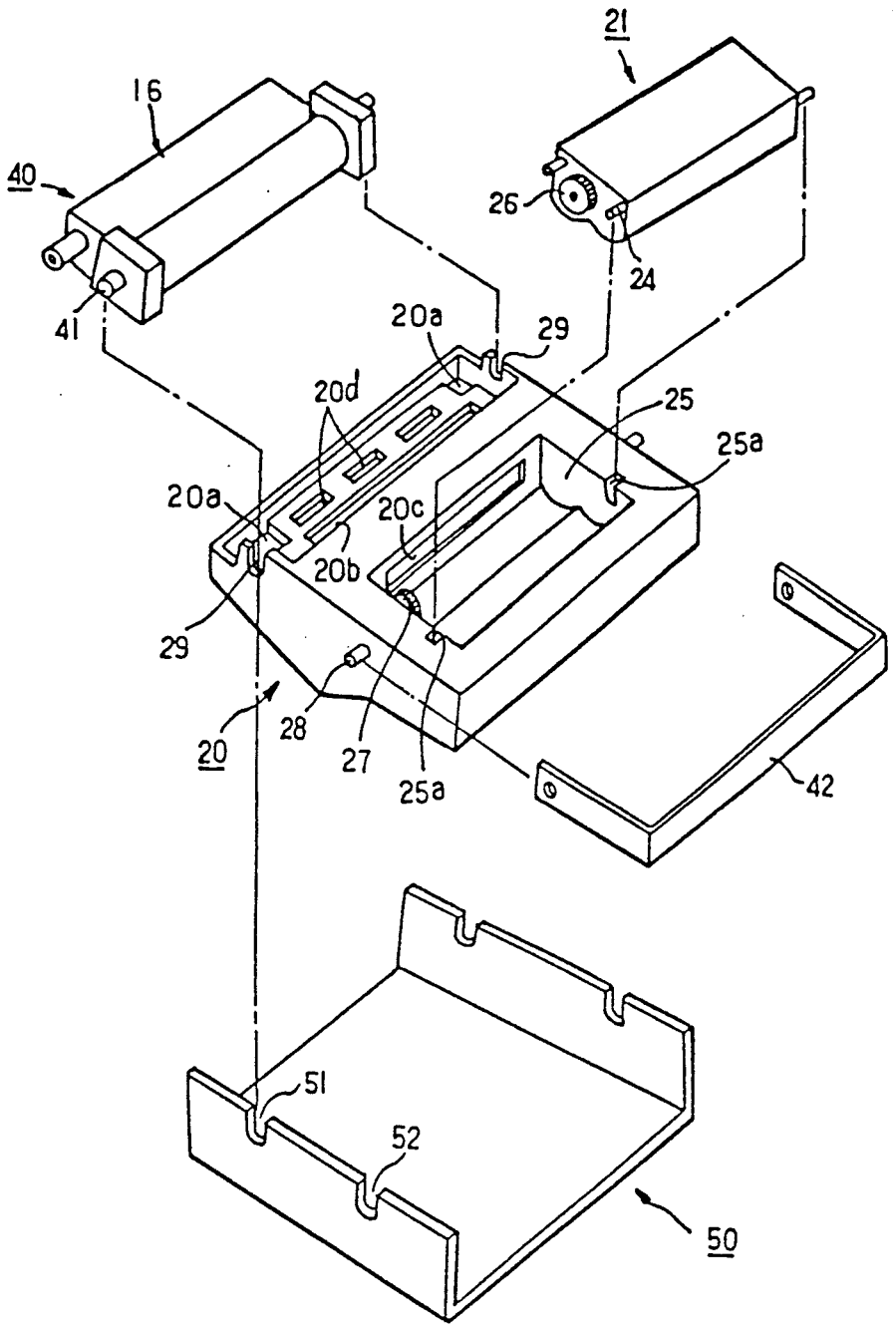
FIG. 3 is a perspective view of the essential part of the inventive processor.

Referring to FIG. 3, a developing device 20 has guide grooves 29 whereby a drum unit 40 comprising a light-sensitive drum 4 and cleaning device 16 is installed by inserting positioning hinge shaft 41, and a large rectangular basin 25 is formed on the other side. The toner box 21 has a hinge shaft 24 on both sides and toner supply gear 26 on one side inserted into and meshed with guide grooves **25*a* and drive gear 27 respectively when installing the toner box on the basin 25. The developing device 20 has a projected hinge pin 28 where a handle 42 is installed and this handle is to be used when removing and installing the unit 20. The developing unit 20 is installed on a main body frame 50**.

To assemble all the units, the developing device 20 assembled with drum device 40 and toner box 21 is installed on the main body frame 50 by lifting the handle 42 horizontally.

The positioning hinge shafts 28 of the developing device 20 are inserted into guide grooves 52 of the frame 50 and the positioning hinge shafts 41 of the drum unit 40 are inserted into guide grooves 51 of the frame 50 through guide grooves 29 of the developing device 20.

The hole **20*a* formed on the part of the developing device 20 where the drum unit 40 is to be installed is for accommodating power supply means from the main body to the drive system and a charging device 5 of drum unit 40. An opening 20*b* is to pass the light of the light emitting device 11. And an elongated opening 20*c*** formed on a side of the basin 25 is to pass the toner from the toner box. A plurality of holes 20*d* is for air flow to eliminate ozone generated from the charging device 5 and heat accumulated by the fixing device 8.

As explained above, the developing device 20, the drum unit 40 and the toner box 21 are integrated in a unit and this integrated unit is installed in the main body frame 50.

Figure 4:
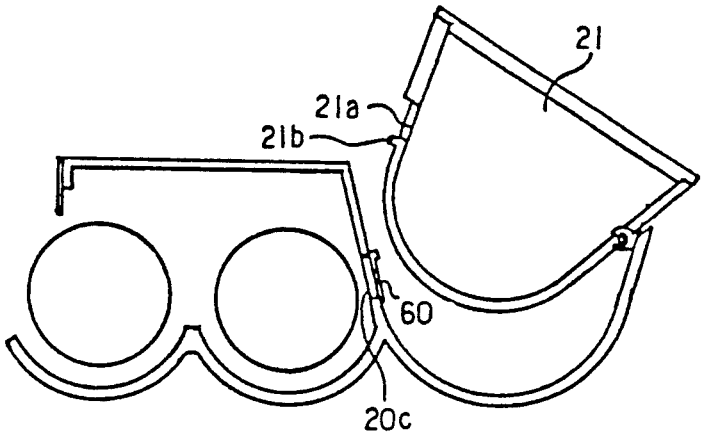
FIG. 4 is a view a for illustrating the operation of the essential part of an embodiment of the inventive processor.

When disassembling the inventive electrophotography processor, the toner box or the drum unit is first detached and thereafter the remaining parts. And also the toner box, drum unit and developing device are disassembled from each other in order. When installing and removing the toner box, a shutter is required to open and close the elongated opening 20*c* to prevent the toner from leaking. As shown in FIG. 4, the shutter is installed on the elongated opening 20*c* formed on a side wall of the basin 25 and a projection 21*b* is formed on a side wall of the toner box 21. When rotating the toner box 21 about a hinge shaft 24, the toner box is inserted into the basin and the projection 21*b* presses the shutter to be opened downward and the elongated opening 20*c* is connected to a corresponding elongated opening 21*a* at the same time. When removing the toner box, the shutter moves upwardly closed by force of a spring not shown in the drawing.

Figure 5:
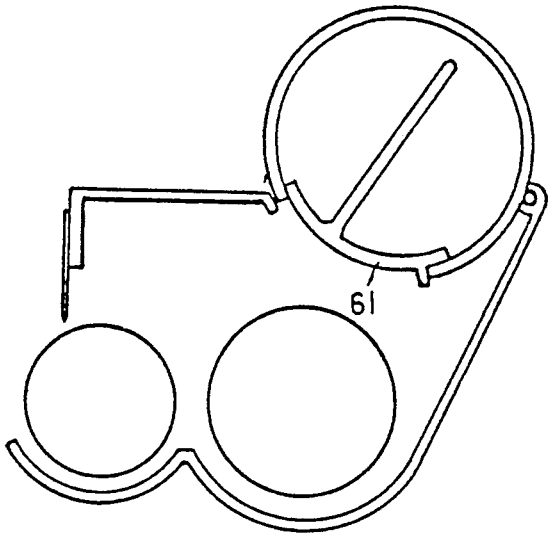
FIG. 5 is view for illustrating the operation of the essential part of another embodiment of the inventive processor.

In another embodiment as shown in FIG. 5, a shutter with a knob 61 is installed at the elongated opening 21*a* of the toner box 21 so as to open and close by rotating the knob after installing the toner box 21 in the developing device 20.

The operation of the inventive electrophotography processor is as follows:

The corona discharged from the corona wire 5' of the charging device 5 charged with high voltage current makes the surface of the light-sensitive drum 4 charged.

When the charged surface of the light-sensitive drum 4 is exposed to the light reflected from a manuscript, the exposed and unexposed portions of the surface of the drum are charged with different voltages and an electrically latent image is formed on the surface.

The light emitting device comprises a laser diode, LED head array, or lamp. The electrically latent image formed on the surface of the light sensitive drum is developed by the developing device and toner. The developed image on the surface of the drum is transferred to a paper 2' delivered from a paper cassette by a register roller. The residual toner on the surface of the light-sensitive drum 4 is eliminated by the cleaning device 16 and the transferred image on the paper is fixed by the fixing device. The printed paper is transmitted to a tray by the discharging roller.

In conclusion, the inventive electrophotography processor is economical because each component part can be replaced without scrapping the related parts and units having service life and repair work can be done easily.

What is claimed is:

1. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, and said drum section having a pair of guide grooves adaptable to receive a light-sensitive drum unit, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

2. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, said rectangular basin having a first elongated opening formed in a side wall of said rectangular basin facing toward said drum section, said toner unit having a corresponding elongated opening formed in a side wall, said first elongated opening and said corresponding elongated opening being connected together when installing said toner unit within said rectangular basin of said developer body, and said drum section having a pair of guide grooves adaptable to receive a light-sensitive drum unit, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

3. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, said rectangular basin having a first elongated opening formed in a side wall of said rectangular basin facing toward said drum section, said toner unit having a corresponding elongated opening formed in a side wall, said toner unit comprising a shutter biased by a spring so as to close said first elongated opening and a projection formed on the lower side of said corresponding elongated opening, said shutter being pressed opened by said projection when said toner unit is inserted into said rectangular basin, and said drum section having a pair of guide grooves adaptable to receive a light-sensitive drum unit, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

4. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, said rectangular basin having a first elongated opening formed in a side wall of said rectangular basin facing toward said drum section, said toner unit having a corresponding elongated opening formed in a side wall, said toner unit comprising a shutter adaptable to control said corresponding elongated opening, and a rotatable knob provided at a central axis of said toner unit to open and close said shutter, and said drum section having a pair of guide grooves adaptable to receive a light-sensitive drum unit, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

5. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, and said drum section having a pair of guide grooves adaptable to receive a light-sensitive drum unit, wherein said toner unit is detachable from said rectangular basin of said toner supply section and said light-sensitive drum unit is detachable from said drum section;

said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame; and a handle mountable onto said pair of hinge pins of said developer body for disassembling said developer body from said main body frame.

6. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, and said drum section having a pair of guide grooves adaptable to receive a light-sensitive drum unit and said drum section having a plurality of apertures for providing directional airflow within said developer body, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

7. An electrophotography processor, comprising:

a main body frame having two oppositely positioned and spaced apart supporting walls, each of said supporting walls having first and second pairs of guide grooves;

a developer body detachedly positionable within said main body frame having a toner supply section and a drum section being separated by a cross-sectional area, said developer body having a pair of hinge pins respectively mountable on both sides of said developer body coaxially with said first pair of guide grooves of said main body frame, said toner supply section having a rectangular basin adaptable to receive a toner unit within said rectangular basin, and said drum section having a pair of guide grooves adaptable to receive a light-sensitive drum unit and said drum section having an elongate opening formed in a side wall facing toward said rectangular basin for enabling production of images onto said printable medium, wherein said toner unit is detachable from said rectangular basin of said toner supply section and said light-sensitive drum unit is detachable from said drum section; and said light-sensitive drum unit comprising a light-sensitive drum, a cleaning device and a charging device for developing images onto a printable medium, said light-sensitive drum unit having a pair of hinge pins respectively mountable on opposite sides of said light-sensitive drum unit co-axially with said second pair of guide grooves of said main body frame.

* * * * *